US006886349B1

(12) United States Patent
Curicuta et al.

(10) Patent No.: US 6,886,349 B1
(45) Date of Patent: May 3, 2005

(54) BRAZED ALUMINUM HEAT EXCHANGER

(75) Inventors: Victor Curicuta, Carrollton, TX (US); Mark W. Olsen, Carrollton, TX (US); Oved W. Hanson, Carrollton, TX (US)

(73) Assignee: Lennox Manufacturing Inc., Richardson, TX (US)

( * ) Notice: Subject to any disclaimer, the term of this patent is extended or adjusted under 35 U.S.C. 154(b) by 0 days.

(21) Appl. No.: 10/744,157

(22) Filed: Dec. 22, 2003

(51) Int. Cl.[7] ..... F25B 45/00

(52) U.S. Cl. ..... 62/77; 62/298; 62/515; 165/178; 29/890.043; 29/890.046; 29/890.054; 285/288.11

(58) Field of Search ..... 62/71, 298, 515; 165/178; 29/890.054, 890.046, 890.043; 285/288.1, 288.11, 329

(56) References Cited

U.S. PATENT DOCUMENTS 4,396,059 A * 8/1983 Banner et al. ..... 165/134.1
4,621,839 A * 11/1986 Duell et al. ..... 285/61
4,691,769 A * 9/1987 Flamm et al. ..... 165/158
4,738,310 A * 4/1988 Luttenberger et al. ..... 165/158
4,761,866 A * 8/1988 Murphy ..... 29/890.044
4,991,647 A 2/1991 Kawabe et al.
5,125,452 A 6/1992 Yamauchi et al.
5,292,595 A 3/1994 Yamauchi et al.
5,422,191 A 6/1995 Childree
5,513,700 A * 5/1996 Kleve et al. ..... 165/153
5,524,707 A * 6/1996 Fredrich ..... 165/79
5,579,650 A * 12/1996 Cleland et al. ..... 62/392
5,732,767 A 3/1998 Saperstein
5,775,403 A * 7/1998 Premkumar et al. ..... 164/98
6,129,143 A * 10/2000 Hasegawa et al. ..... 165/133
6,206,085 B1 * 3/2001 Correa ..... 165/67
6,428,374 B1 * 8/2002 Nuss ..... 440/88 R
6,620,265 B2 9/2003 Kawahara et al.
6,627,330 B1 9/2003 Shimizu et al.
6,675,746 B2 * 1/2004 Gerstmann et al. ..... 122/367.1

FOREIGN PATENT DOCUMENTS

DE 004238742 A1 * 5/1994
GB 2296560 A * 7/1996
JP 357021793 A * 2/1982
US EP000176275 A1 * 4/1986

* cited by examiner

*Primary Examiner*—William E. Tapolcai
*Assistant Examiner*—Mohammad M. Ali

(57) ABSTRACT

An aluminum heat exchanger is provided. In one embodiment, the aluminum heat exchanger comprises a fin having a first aperture therethrough with a flange formed around the first aperture. The fin is made from a first alloy having a first melting point. The heat exchanger includes a refrigerant tube made from a second alloy having a second melting point. The refrigerant tube extends through the first aperture. The heat exchanger also has a tubular coupling made from a third alloy having a third melting point and that is coupled to an end of the refrigerant tube. A fourth alloy having a fourth melting point less than the first, second, and third melting points is interposed the refrigerant tube and the flange, and further interposed the refrigerant tube and the tubular coupling. A method of manufacturing and a refrigeration unit are also provided.

22 Claims, 8 Drawing Sheets

BRAZED ALUMINUM HEAT EXCHANGER

TECHNICAL FIELD OF THE INVENTION

The present invention is directed, in general, to a heat exchanger and, more specifically, to a heat exchanger comprising aluminum alloys.

BACKGROUND OF THE INVENTION

The use of aluminum in the manufacture of heat exchangers is well known, because early on, it was recognized that aluminum had very good heat transfer properties and was light weight. However, the manufacture of current A-frame evaporators and condensers are rather labor intensive because they are primarily made with cylindrical tubes that are coupled to the fins by mechanically expanding the tubes into contact with the apertures in the fins. The end plates and copper return tubes are most often hand-brazed to the refrigerant tubes. Furthermore, assembly requires brazing joints between the various parts, and this involves locating the brazing material at the joints along with a suitable flux. Thus, poor braze joints can result in separation of the heat exchanger tubes from the manifold resulting in a leak, or the separation of the fin from the tube, thereby reducing the heat exchanger efficiency.

Accordingly, what is needed in the art is an aluminum heat exchanger and a method of manufacturing the heat exchanger that is simpler and results in better, more uniform braze joints.

SUMMARY OF THE INVENTION

To address the above-discussed deficiencies of the prior art, the present invention provides an aluminum heat exchanger. In one embodiment, the aluminum heat exchanger comprises a fin having a first aperture therethrough with a flange formed around the first aperture. The fin is made from a first alloy having a first melting point. The heat exchanger includes a refrigerant tube made from a second alloy having a second melting point. The refrigerant tube extends through the first aperture. The heat exchanger also has a tubular coupling made from a third alloy having a third melting point and that is coupled to an end of the refrigerant tube. A fourth alloy having a fourth melting point less than the first, second, and third melting points is interposed the refrigerant tube and the flange, and further interposed the refrigerant tube and the tubular coupling. A method of manufacturing and a refrigeration unit are also provided.

The foregoing has outlined preferred and alternative features of the present invention so that those skilled in the art may better understand the detailed description of the invention that follows. Additional features of the invention will be described hereinafter that form the subject of the claims of the invention. Those skilled in the art should appreciate that they can readily use the disclosed conception and specific embodiment as a basis for designing or modifying other structures for carrying out the same purposes of the present invention. Those skilled in the art should also realize that such equivalent constructions do not depart from the spirit and scope of the invention.

BRIEF DESCRIPTION OF THE DRAWINGS

For a more complete understanding of the present invention, reference is now made to the following descriptions taken in conjunction with the accompanying drawings, in which.

DETAILED DESCRIPTION

Figure 1:
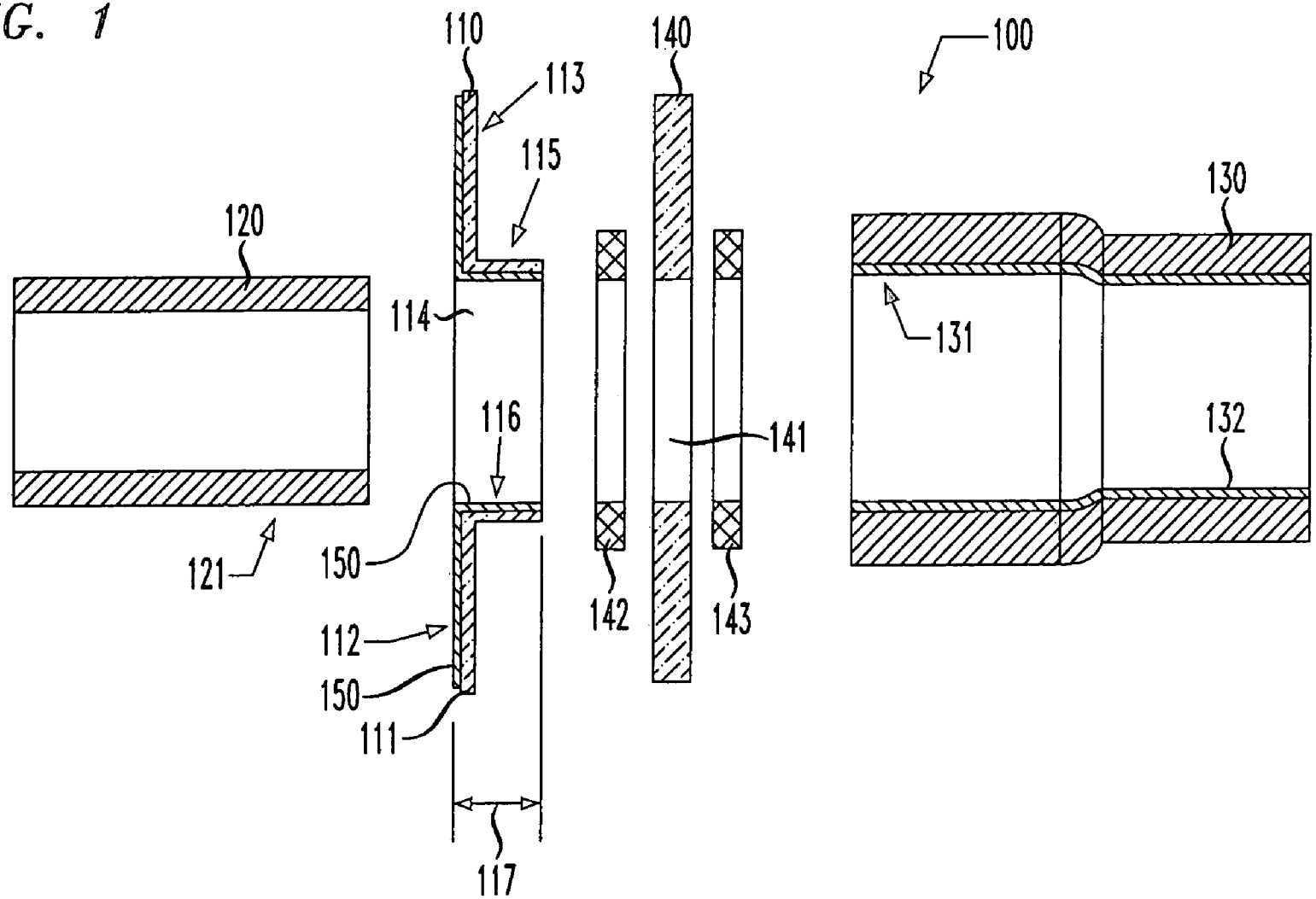
FIG. 1 illustrates an exploded sectional view of representative elements of one embodiment of an aluminum heat exchanger to be constructed in accordance with the principles of the present invention.

Referring initially to FIG. 1, illustrated is an exploded sectional view of representative elements of one embodiment of an aluminum heat exchanger 100 to be constructed in accordance with the principles of the present invention. The heat exchanger 100 comprises a plurality of fins 110 (one shown), a plurality of refrigerant tubes 120 (one shown), a plurality of tubular couplings 130 (one shown), and an end plate 140. This embodiment is particularly useful for manufacturing a heat exchanger using conventional extruded aluminum tubing. For the purposes of this discussion, a tubular coupling is a coupling that connects an end of one refrigerant tube to an end of another tube, so as to provide a singular path for a refrigerant. Therefore, a tubular coupling is distinguished from a manifold which couples together a plurality of refrigerant tube ends with a single device using a common space to distribute a fluid among the plurality of tubes. A tubular coupling may be straight, bent, as in a U-shape or another geometric configuration, and also may couple different size tubes, while still being considered a tubular coupling.

In the illustrated embodiment, the fin 110, refrigerant tube 120, tubular coupling 130, and end plate 140 may be composed of various but well known aluminum alloys. For example, the fin 110 may have a core 111 comprised of a first aluminum alloy while the refrigerant tube 120 is made of a second aluminum alloy and the tubular coupling 130 is formed from a third aluminum alloy. The alloys may be different, or they may be the same. In those embodiments where the alloys are different, each alloy comprises some combination of either different elements or different proportions. Thus, in such instances, the first, second, and third alloys will have different melting points. In those embodiments where the alloys are the same or substantially the same, the melting points would be the same or close enough such that they would not melt during a brazing process.

In one particular embodiment, the first aluminum alloy, and therefore the fin 110, may be made of 3003 aluminum alloy. For example, 3003 aluminum alloy comprises: 0.05% to 0.2% copper, <0.7% iron, 1.0% to 1.5% manganese, <0.6% silicon, ≦0.1% zinc by weight, and the balance aluminum. The refrigerant tube 120 may be extruded from 1100 aluminum alloy. In the illustrated embodiment, the fin core 111 has two outer surfaces 112, 113. The fin 110 has an aperture 114 formed therethrough such that a flange 115 is created. A fourth aluminum alloy 150 is clad to at least one outer surface 112 and may also have the fourth aluminum alloy (not shown) clad to the second outer surface 113. The fourth aluminum alloy 150 is also clad to an inner surface 116 of the flange 115. The tubular coupling 130 also has an inner surface 131 to which an inner layer 132 of the fourth aluminum alloy 150 is clad. In accordance with the present invention, the fourth aluminum alloy 150 has a fourth melting point that is less than the first melting point, the second melting point, and the third melting point. For example, the fourth aluminum alloy may be a 4XXX series aluminum alloy, i.e., 4045, 4047, or 4343, having a high silicon content. It is well known that high silicon content alloys have lower melting points than the 3XXX series aluminum alloys. For example, 4343 aluminum alloy comprises: 0.25% copper, <0.8% iron, 0.1% manganese, 6.8% to 8.2% silicon, ≦0.2% zinc by weight, and the balance aluminum. This alloy is known to have a melting point of between 577° C. and 613° C. Regardless of what the alloys of the structural elements are, the melting point of the fourth alloy 150 must be sufficiently below the melting points of the other three alloys so that there is no chance of melting the heat exchanger structural elements during brazing in a furnace.

The fin 110 has an aperture 114 therethrough for receiving an end 121 of the refrigerant tube 120. The tubular coupling 130 including inner clad layer 132 is sized to accept the refrigerant tube end 121. The end plate 140 has an end plate aperture 141 configured to receive the refrigerant tube end 121 therethrough. Aluminum alloy rings 142, 143 are placed on either sides of the end plate 140 and around the refrigerant tube 120. The aluminum alloy rings 142, 143 are of an alloy that is the same or similar in melting point to the fourth aluminum alloy 150. One who is of skill in the art is familiar with tube brazing rings.

It should be noted that only a longitudinal section of the refrigerant tube 120 is shown and it should be understood that a cross section of the refrigerant tube 120 may be of a circular, oval, racetrack or other cross section suitable for carrying a refrigerant and is not a limitation of the present invention. Appropriately, the fin aperture 114 and the end plate aperture 141 conform to the general cross sectional shape of the tube 120. A length of the flange 117 determines a distance between adjacent fins. One who is skilled in the art is familiar with the process of stacking fins to determine their ultimate spacing.

Figure 2A:
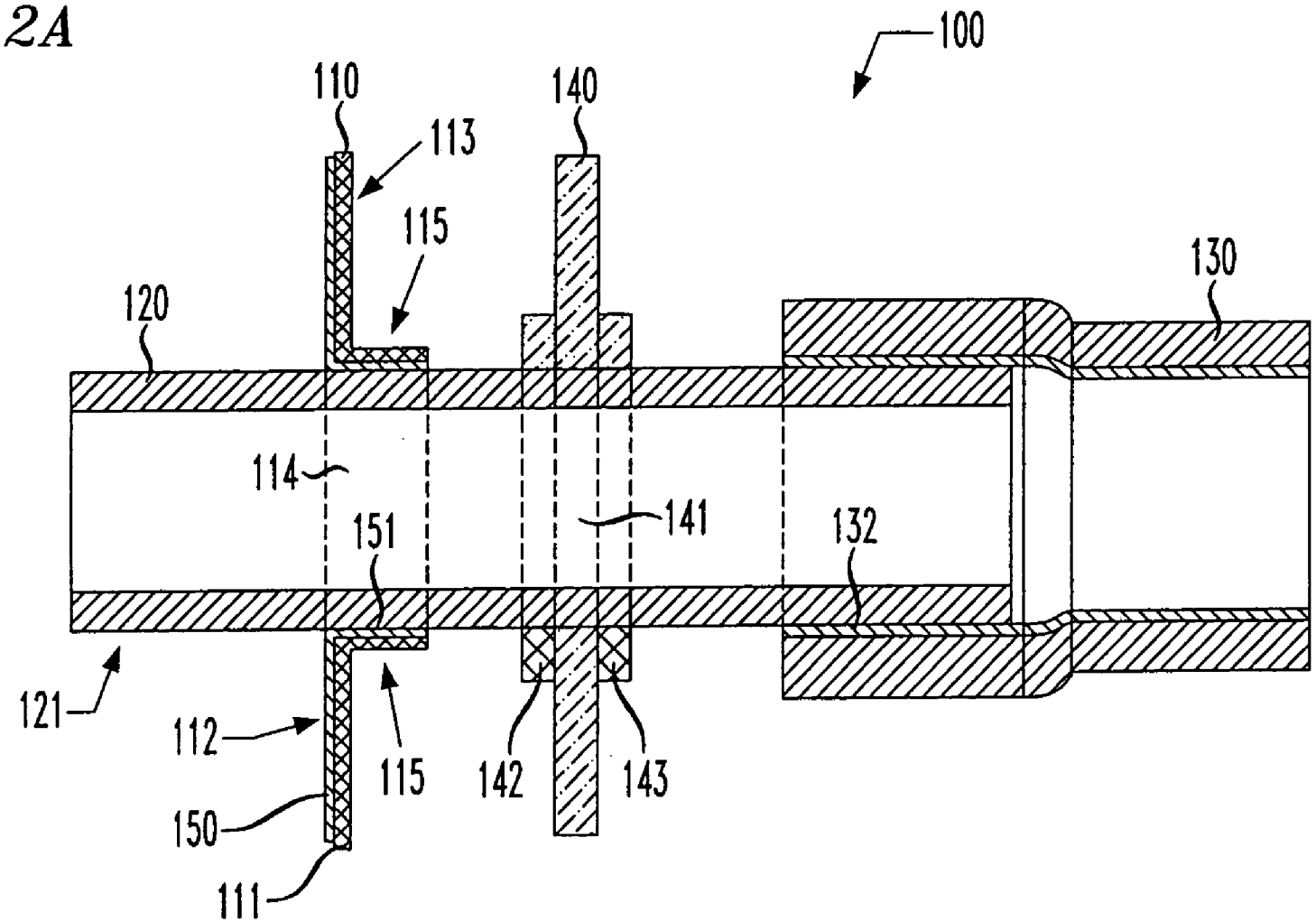
FIG. 2A illustrates a sectional view of the assembled representative elements of the aluminum heat exchanger of FIG. 1 prior to brazing.

Referring now to FIG. 2A, illustrated is a sectional view of the assembled representative elements of the aluminum heat exchanger 100 of FIG. 1 prior to brazing. As can be seen, the refrigerant tube 120 has been inserted through the fin aperture 114 and the end plate aperture 141 in such a manner that at least a portion 151 of the fourth aluminum alloy 150 clad to the fin 110 is interposed the fin 110 and the refrigerant tube 120. Furthermore, the inner layer 132 of the tubular coupling 130 is interposed a portion of the tubular coupling 130 and the refrigerant tube 120. The fourth aluminum alloy 150 clad to the surface 112 of the fin core 111 and the inner layer 132 of the tubular coupling 130 are formulated such that they have a lower melting point than the alloy compositions of the fin 110, refrigerant tube 120, tubular coupling 130, and end plate 140. Additionally, aluminum alloy rings 142, 143 are located around the refrigerant tube 120 on either side of the aluminum end plate 140. In a preferred embodiment, the aluminum alloy rings 142, 143 may comprise the fourth aluminum alloy, or alternatively an aluminum alloy having a similar melting point to the fourth melting point. When assembled as shown, and subjected to a brazing furnace at a temperature above the fourth melting point, but below the first, second, and third melting points, the clad alloy 112 and the inner layer 132 flow to braze the components together.

Figure 2B:
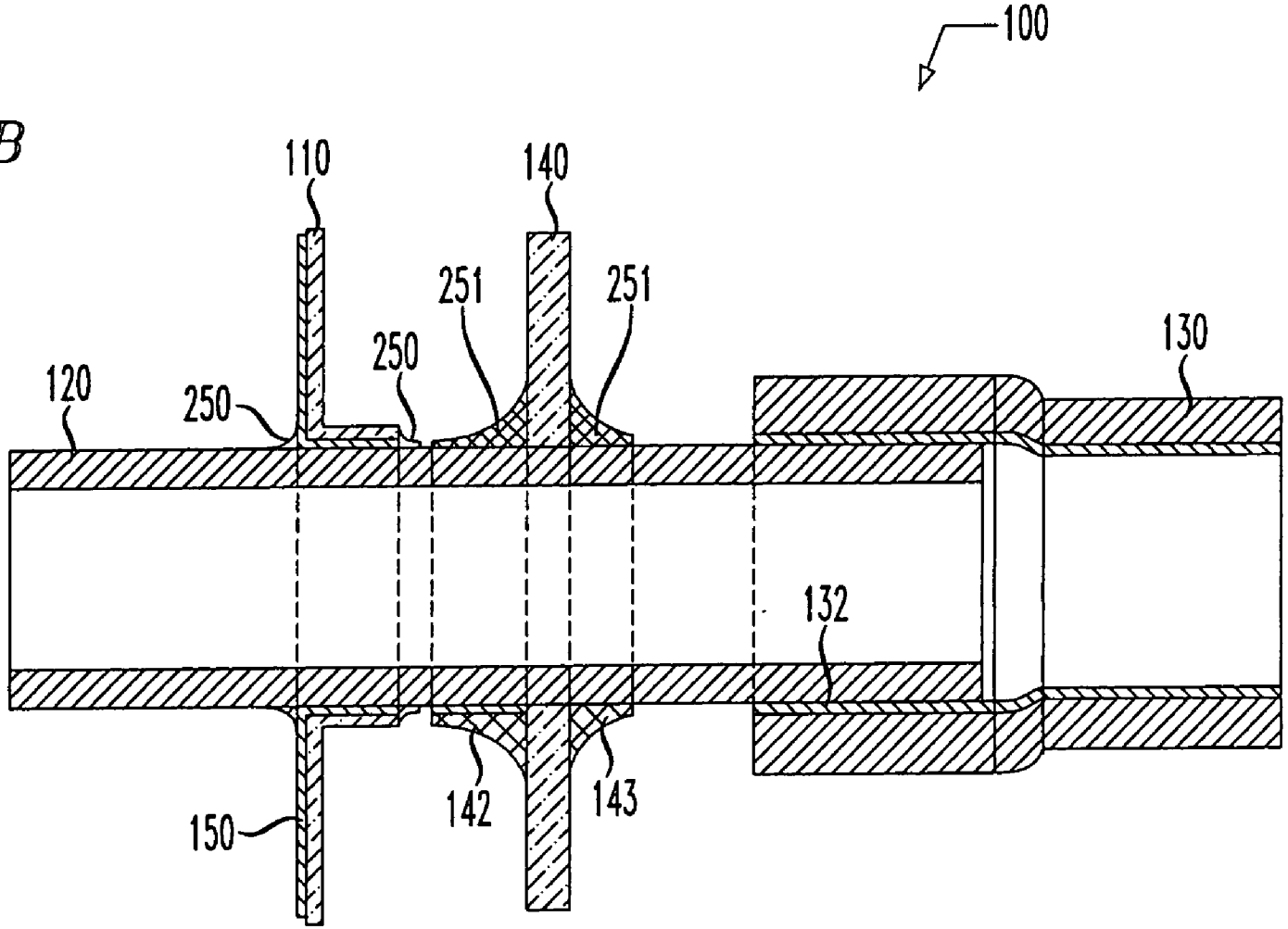
FIG. 2B illustrates the heat exchanger of FIG. 1 after brazing.

Referring now to FIG. 2B, illustrated is the heat exchanger of FIG. 1 after brazing. After having been heated to the fourth melting point and then cooled below the fourth melting point, the clad alloy 112 and the inner layer 132 solidify and form fillets 250 and a rigid bond between the refrigerant tube 120 and the fin 110 and between the refrigerant tube 120 and the tubular coupling 130. Similarly, the aluminum rings 142, 143 of FIG. 2A have melted and hardened to form end plate fillets 251 and a rigid coupling between the end plate 140 and the refrigerant tube 120.

Figure 3:
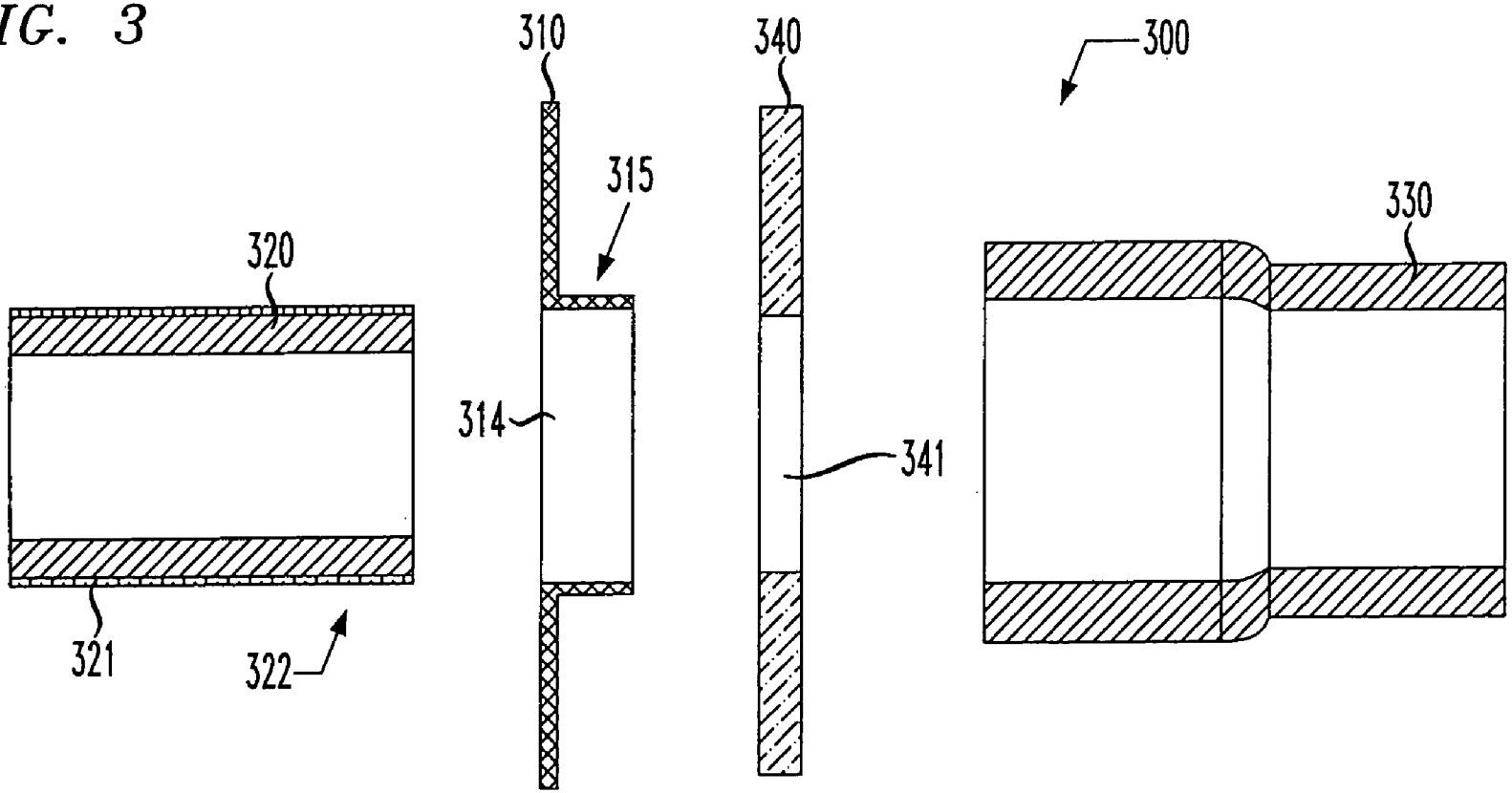
FIG. 3 illustrates an exploded sectional view of representative elements of an alternative embodiment of an aluminum heat exchanger to be constructed in accordance with the principles of the present invention.

Referring now to FIG. 3, illustrated is an exploded sectional view of representative elements of an alternative embodiment of an aluminum heat exchanger 300 to be constructed in accordance with the principles of the present invention. This embodiment is particularly useful for manufacturing a heat exchanger from conventional welded aluminum tubing. The aluminum heat exchanger 300 comprises a fin 310, a refrigerant tube 320, a tubular coupling 330, and an end plate 340. The fin 310, refrigerant tube 320, tubular coupling 330, and end plate 340 are composed of various aluminum alloys as in the embodiment of FIG. 1. Again, the fin 310 may comprise a first aluminum alloy with the refrigerant tube 320 being of a second aluminum alloy and the tubular coupling 330 formed from a third aluminum alloy. Likewise, the first aluminum alloy has a first melting point, the second aluminum alloy has a second melting point, and the third aluminum alloy has a third melting point. In this embodiment, the refrigerant tube 320 has a fourth aluminum alloy 321 clad to an outer surface thereof, wherein the fourth aluminum alloy 321 has a fourth melting point that is less than the first melting point, the second melting point, or the third melting point. The first aluminum alloy may, in one embodiment, be aluminum 3003 alloy. In contrast to the embodiment of FIG. 1, the tubular coupling 330 does not have an inner layer of the fourth aluminum alloy 321. The fin 310 has an aperture 314 therethrough and a flange 315 formed for receiving an end 322 of the refrigerant tube 320.

In one embodiment, the refrigerant tube 320 may be formed and welded from 3003 aluminum alloy. Again, the refrigerant tube 320 may be of any suitable cross section. The tubular coupling 330 is configured to couple to the end 322 of the refrigerant tube 320. The end plate 340 has an end section aperture 341 configured to receive the end 322 therethrough. Aluminum alloy rings are not required in this embodiment.

Figure 4A:
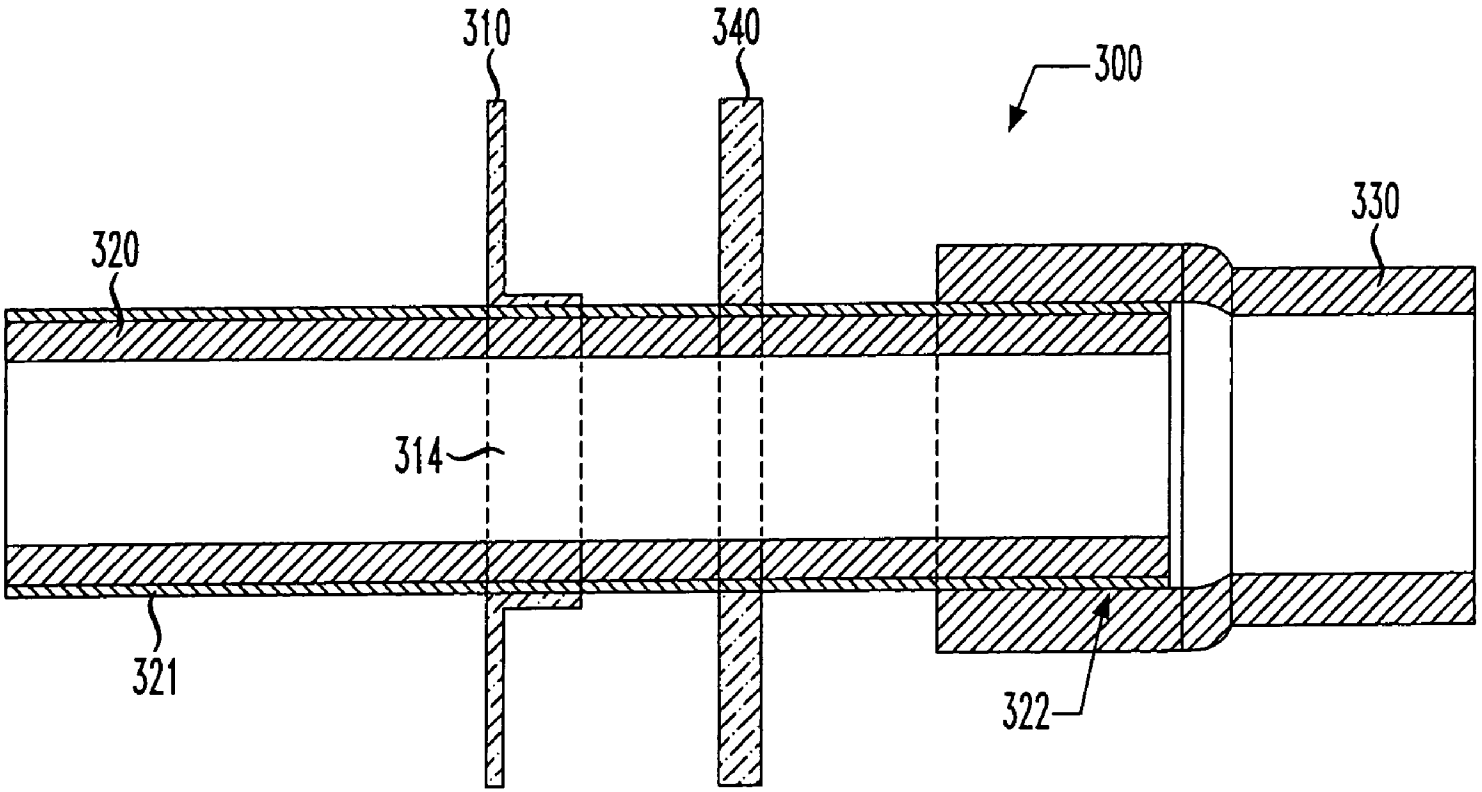
FIG. 4A illustrates a sectional view of the assembled representative elements of the aluminum heat exchanger of FIG. 3 prior to brazing.

Referring now to FIG. 4A, illustrated is a sectional view of the assembled representative elements of the aluminum heat exchanger 300 of FIG. 3 prior to brazing. As can be seen, the refrigerant tube 320 has been inserted through the aperture 314 and the end section aperture 341 in such a manner that at least a portion of the fourth aluminum alloy 321 clad to the refrigerant tube 320 is interposed the refrigerant tube 320 and the fin 310. Furthermore, the fourth aluminum alloy 311 clad to the refrigerant tube 320 is interposed the tubular coupling 330 and the refrigerant tube 320. The fourth aluminum alloy 321 is formulated such that it has a lower melting point than the alloy compositions of the fin 310, refrigerant tube 320, tubular coupling 330, and the end plate 340. When assembled as shown, and subjected to a brazing furnace at a temperature above the fourth melting point, but below the first, second, and third melting points, the fourth aluminum alloy 311 flows as is well known in the art.

Figure 4B:
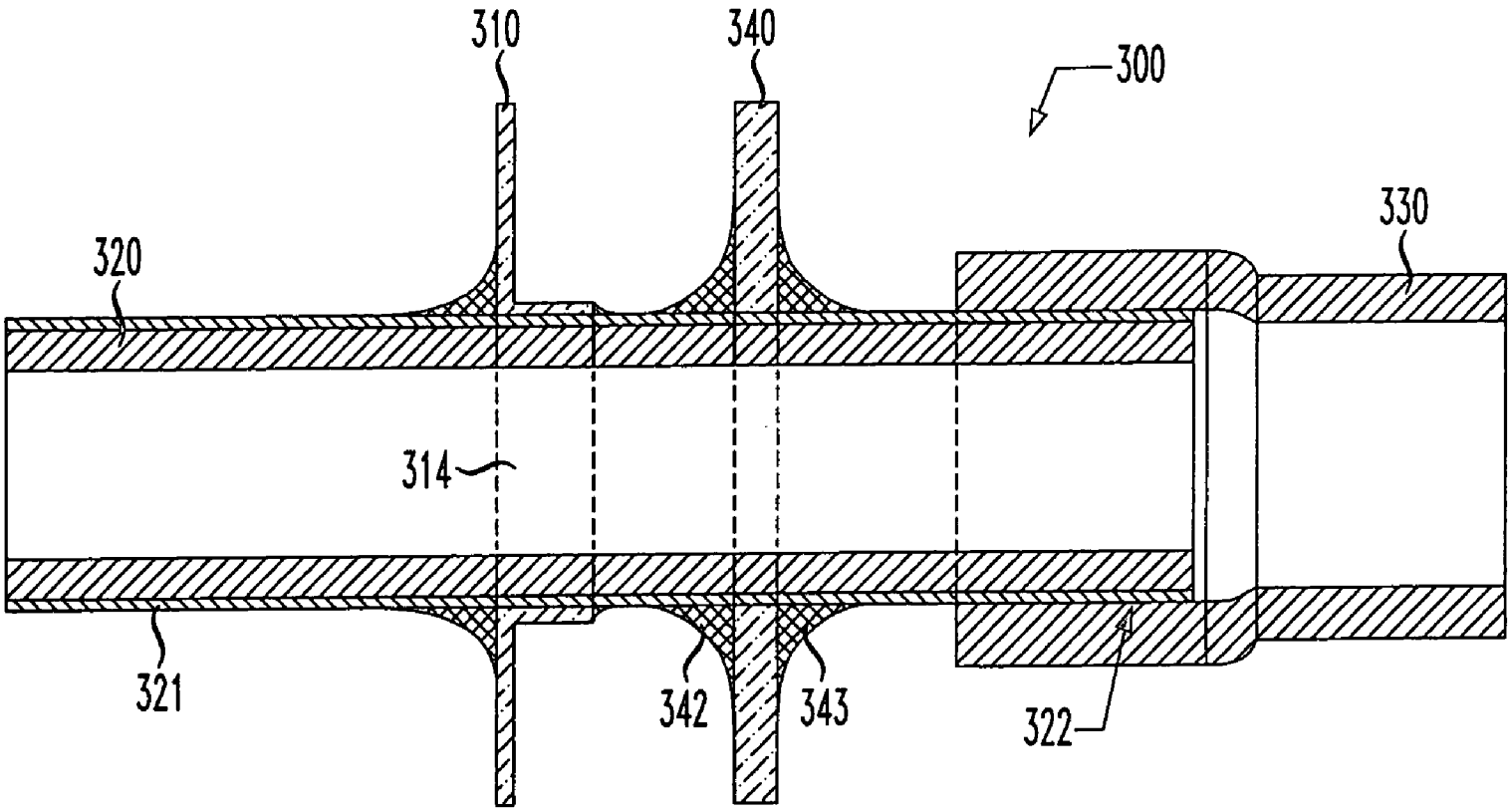
FIG. 4B illustrates the heat exchanger of FIG. 3 after brazing.

Referring now to FIG. 4B, illustrated is the heat exchanger of FIG. 3 after brazing. When subsequently cooled below the fourth melting point, the fourth aluminum alloy 311 solidifies and forms a rigid bond between the refrigerant tube 320 and the fin 310, and between the refrigerant tube 320 and the tubular coupling 330. Similarly, the aluminum rings 341 of FIG. 4A have melted and then hardened to form a rigid coupling between the end plate 340 and the refrigerant tube 320. This embodiment is particularly advantageous in that only one of the structural elements of the heat exchanger, i.e., the refrigerant tubing, need have the cladding thereupon.

Brazing furnaces have an opening through which the heat exchanger assembly is passed on a conveyor belt thereby exposing the assembly to a uniform temperature that flows all of the brazing material. By constructing the assembly entirely of aluminum or aluminum alloys and even using an aluminum material that is the brazing material, i.e., the fourth aluminum alloy, uniform braze joints can be achieved. This also eliminates hand brazing of the return tubes, and other hand manufacturing, such as expanding the tube to engage against cooling fins. However, when using a brazing furnace, one must take into account the available opening of the furnace. That is, the assembly should approximate the size of the opening to keep the brazing in a nitrogen-rich atmosphere, avoiding oxygen which will oxidize the parts and encourage corrosion.

Figure 5A:
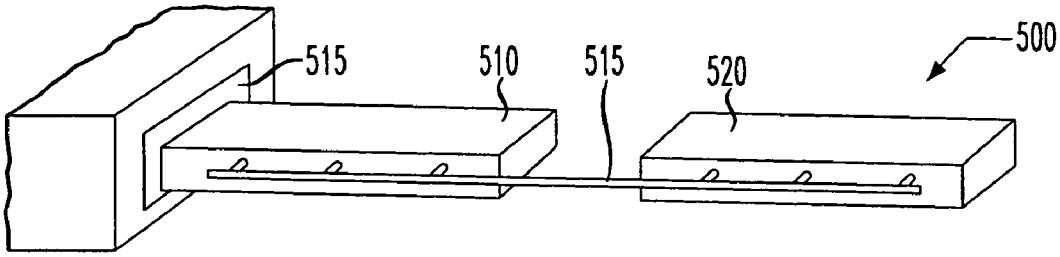
FIG. 5A illustrates one embodiment of the heat exchanger of FIG. 1 as evaporator coils could be formed in a low clearance furnace.
Figure 5B:
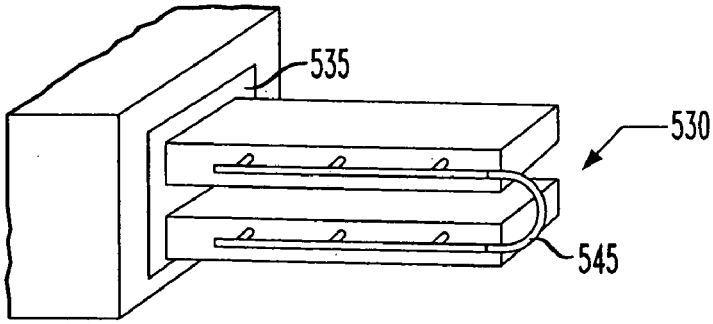
FIG. 5B illustrates an alternative embodiment of the heat exchanger that could be manufactured in a furnace having a higher clearance.
Figure 5C:
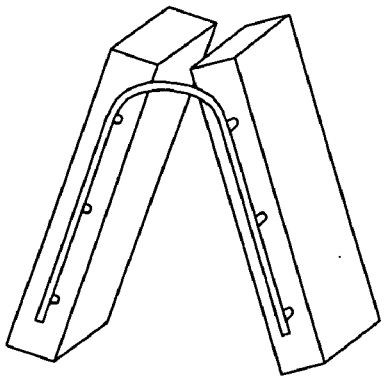
FIG. 5C illustrates the heat exchanger of either FIG. 5A or FIG. 5B after bending to the traditional A-frame shape of conventional evaporator coils.

Referring now to FIG. 5A, illustrated is one embodiment of the heat exchanger 500 of FIG. 1 as evaporator coils could be formed in a low clearance furnace. In this embodiment, first and second coils 510, 520 comprise the heat exchanger 500 and are coupled by substantially-straight tubing 515. Manufacturing the heat exchanger 500 in this form allows the assembly to be passed through a furnace having a very low clearance 515 and yet be manufactured without hand brazing of tubing 515 to the first and second coils 510, 520. Alternatively, as shown in FIG. 5B, illustrated is an alternative embodiment 530 of the heat exchanger that could be manufactured in a furnace having a higher clearance 535. In this case, the tubing 545 is pre-bent to a substantially U-shape before brazing the heat exchanger 530. Thus, the heat exchanger 500 can be fully assembled and then brazed in a controlled atmosphere brazing furnace of appropriate size. After being removed from the furnace, the heat exchanger can then be bent to or unbent to the familiar A-frame shape. FIG. 5C illustrates the heat exchanger of either FIG. 5A or FIG. 5B after bending to the traditional A-frame shape of conventional evaporator coils. Therefore, all of the hand brazing that was previously required has been eliminated by the principles of the present invention.

Figure 6:
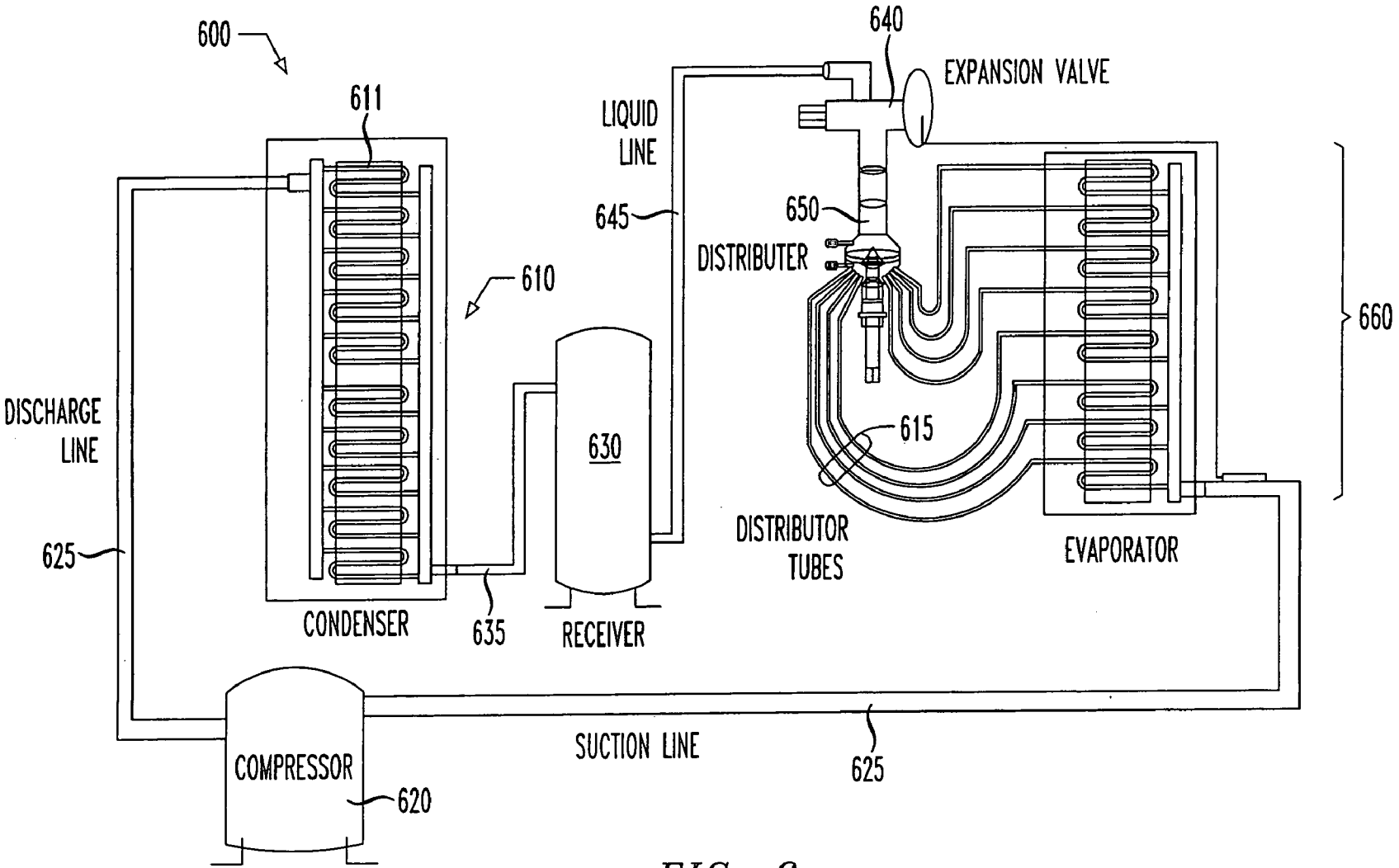
FIG. 6 illustrates a refrigeration/air conditioning system, which may be commercial or residential in nature, comprising a heat exchanger constructed according to the present invention.

Referring now to FIG. 6, illustrated is a refrigeration/air conditioning system 600, which may be commercial or residential in nature, comprising a heat exchanger 610 constructed according to the present invention. In this embodiment, the heat exchanger 610 functions as a condenser 610. The refrigeration/air conditioning system 600 may also be referred to as a vapor compression system 600 as the components of each are analogous or similar. The refrigeration/air conditioning system 600 further comprises a compressor 620, a receiver 630, an expansion valve 640, a distributor 650, and a plurality of evaporator circuits 660. The compressor 620 is coupled to the condenser 610 by a discharge line 625. The receiver 630 is coupled to the condenser 610 by a first liquid line 635. The expansion valve 650 is coupled to the receiver 640 by a second liquid line 645. The distributor 650 is directly coupled downstream to the expansion valve 650. A plurality of distributor tubes 615 couple the distributor 650 to the plurality of evaporator circuits 660. A suction line 625 couples the outlets of the plurality of evaporator circuits 660 to the inlet of compressor 620, completing a closed system. The heat exchanger/condenser 610 shown is a single unit having a plurality of interconnected tubes 611 manufactured as described in the present invention. Additionally, it should be noted that the plurality of evaporator circuits 660 may use the same principles for manufacturing as has been described for the heat exchanger/condenser 610.

Thus, a heat exchanger and a method of manufacturing the same has been described that takes advantage of selectively cladding particular portions of elements of the heat exchanger with an aluminum alloy that acts as the brazing material when heated above its melting point.

Although the present invention has been described in detail, those skilled in the art should understand that they can make various changes, substitutions and alterations herein without departing from the spirit and scope of the invention in its broadest form.

What is claimed is:

1. An aluminum heat exchanger, comprising:

a fin having a first aperture therethrough with a flange formed around said first aperture, said fin made from a first aluminum alloy having a first melting point;

a refrigerant tube made from a second aluminum alloy having a second melting point, said refrigerant tube extending through said first aperture;

a tubular coupling made from a third aluminum alloy having a third melting point and coupled to an end of said refrigerant tube; and a fourth aluminum alloy having a fourth melting point less than said first, second, and third melting points, said fourth aluminum alloy interposed said refrigerant tube and said flange, and further interposed said refrigerant tube and said tubular coupling.

2. The aluminum heat exchanger as recited in claim 1 wherein at least two of said first, second and third alloys are the same.

3. The aluminum heat exchanger as recited in claim 1 wherein at least two of said first, second and third melting points are the same.

4. The aluminum heat exchanger as recited in claim 1 wherein said fourth alloy is located on at least a portion of one surface of said flange.

5. The aluminum heat exchanger as recited in claim 1 wherein said fourth alloy is located on at least a portion of an inner surface of said tubular coupling.

6. The aluminum heat exchanger as recited in claim 1 wherein said fourth alloy is located on at least a portion of an outer surface of said refrigerant tube extending beyond said first aperture.

7. The aluminum heat exchanger as recited in claim 1 further comprising an end plate having a second aperture therethrough configured to receive said tube, said end plate interposed said fin and said tubular coupling.

8. The aluminum heat exchanger as recited in claim 1 wherein said heat exchanger forms a part of a refrigeration unit and wherein said refrigeration unit includes a compressor, an expansion valve, and refrigerant tubing coupling said heat exchanger, said compressor, and said expansion valve together in a closed system.

9. The aluminum heat exchanger as recited in claim 1 wherein said heat exchanger is an evaporator or a condenser.

10. A method of manufacturing an aluminum heat exchanger, comprising:

providing a fin having a first aperture therethrough with a flange formed around said first aperture, said fin made from a first alloy having a first melting point;

passing a refrigerant tube through said first aperture, said refrigerant tube made from a second alloy having a second melting point;

placing a tubular coupling on an end of said refrigerant tube, said tubular coupling made from a third alloy having a third melting point, said tubular coupling configured to couple to said tube end;

interposing a fourth alloy between said refrigerant tube and said fin, and further interposing said fourth alloy between said refrigerant tube and said tubular coupling, said fourth alloy having a fourth melting point less than said first, second, and third melting points;

subjecting said heat exchanger to a temperature greater than said fourth melting point but less than said first, second, or third melting points; and cooling said heat exchanger to an ambient temperature less than said fourth melting point.

11. The method as recited in claim 10 wherein at least two of said first, second and third alloys are the same.

12. The method as recited in claim 10 wherein at least two of said first, second and third melting points are the same.

13. The method as recited in claim 10 further comprising locating said fourth alloy on at least a portion of one surface of said fin.

14. The method as recited in claim 10 further comprising locating said fourth alloy on at least a portion of an inner surface of said tubular coupling.

15. The method as recited in claim 10 further comprising locating said fourth alloy on at least a portion of an outer surface of said refrigerant tube extending beyond said first aperture.

16. The method as recited in claim 10 interposing an end plate between said fin and said tubular coupling, said end plate having a second aperture therethrough configured to receive said tube.

17. The method as recited in claim 10 further comprising passing said refrigerant tube through an aperture in an end plate, said end plate interposed said fin and said tubular coupling.

18. The method as recited in claim 10 wherein said heat exchanger forms a part of a refrigeration unit and wherein said refrigeration unit further includes a compressor, an expansion valve, and refrigerant tubing coupling said heat exchanger, said compressor, and said expansion valve together in a closed system.

19. The method as recited in claim 10 wherein said fin, said refrigerant tube and said tubular coupling comprise a first coil, and further comprising:

a second coil; and tubing coupling said first coil and said second coil, wherein said tubing is substantially straight or substantially U-shaped prior to said brazing.

20. The method as recited in claim 19 wherein after brazing said tubing is bent or un-bent until said heat exchanger forms a substantially A-frame shape.

21. A refrigeration unit, comprising:

a heat exchanger forming a part of a refrigeration unit, said heat exchanger having:

a fin having a first aperture therethrough with a flange formed around said first aperture, said fin made from a first aluminum alloy having a first melting point;

a refrigerant tube made from a second aluminum alloy having a second melting point, said refrigerant tube extending through said first aperture;

a tubular coupling made from a third aluminum alloy having a third melting point and coupled to an end of said refrigerant tube; and a fourth aluminum alloy having a fourth melting point less than said first, second, and third melting points, said fourth aluminum alloy interposed said refrigerant tube and said flange, and further interposed said refrigerant tube and said tubular coupling, and a compressor;

an expansion valve; and refrigerant tubing coupling said heat exchanger, said compressor, and said expansion valve together in a closed system.

22. The refrigeration unit as recited in claim 21 wherein said heat exchanger is an evaporator or a condenser.

* * * * *